US010378525B2

(12) United States Patent
Nakamura et al.

(10) Patent No.: US 10,378,525 B2
(45) Date of Patent: Aug. 13, 2019

(54) ELECTRIC PUMP APPARATUS

(71) Applicant: NISSEI PLASTIC INDUSTRIAL CO., LTD., Hanishina-gun, Nagano (JP)

(72) Inventors: Toshiaki Nakamura, Nagano (JP); Kenichi Hayashi, Nagano (JP); Daiki Tanemura, Nagano (JP)

(73) Assignee: NISSEI PLASTIC INDUSTRIAL CO., LTD. (JP)

( * ) Notice: Subject to any disclaimer, the term of this patent is extended or adjusted under 35 U.S.C. 154(b) by 517 days.

(21) Appl. No.: 14/740,357

(22) Filed: Jun. 16, 2015

(65) Prior Publication Data

US 2016/0003226 A1 Jan. 7, 2016

(30) Foreign Application Priority Data

Jul. 2, 2014 (JP) ..... 2014-137167

(51) Int. Cl.
*F04B 17/03* (2006.01)
*F04B 53/08* (2006.01)
(Continued)

(52) U.S. Cl.
CPC ..... *F04B 17/03* (2013.01); *F01C 21/007* (2013.01); *F04B 53/08* (2013.01); *F04B 53/16* (2013.01);
(Continued)

(58) Field of Classification Search
CPC ..... F04B 17/03; F04B 53/08; F04B 53/16; F01C 21/007; F04C 15/0073;
(Continued)

(56) References Cited

U.S. PATENT DOCUMENTS 2,500,228 A * 3/1950 Adams ..... F04D 9/041 417/202
2,886,665 A * 5/1959 Binder ..... F16H 59/0217 200/61.46
(Continued)

FOREIGN PATENT DOCUMENTS

JP 61021885 2/1986
JP 2115975 9/1990
(Continued)

OTHER PUBLICATIONS

Machine Translation of Japanese Patent JP 2013060981 A to Hiroshima.*
(Continued)

*Primary Examiner* — Peter J Bertheaud
*Assistant Examiner* — Dnyanesh G Kasture
(74) *Attorney, Agent, or Firm* — Adams & Wilks

(57) ABSTRACT

A motor-driven apparatus includes a pump and a servo motor connected respectively to outer sides of opposed upstanding support plates. A pump shaft and a servo motor shaft extend horizontally toward each other into a space between the support plates and are coupled together by a flexible coupling. The servo motor includes a fan cover enclosing and spaced from a motor frame of the servo motor. A cooling fan disposed inside the fan cover circulates air in the space between the fan cover and the motor frame to air-cool the motor frame.

13 Claims, 5 Drawing Sheets

(51) Int. Cl.

| | |
|---|---|
| ***F04B 53/16*** | (2006.01) |
| ***F01C 21/00*** | (2006.01) |
| ***F04C 15/00*** | (2006.01) |
| *F04C 2/00* | (2006.01) |

(52) U.S. Cl.
CPC ..... *F04C 15/008* (2013.01); *F04C 15/0073* (2013.01); *F04C 15/0096* (2013.01); *F04C 2/00* (2013.01); *F04C 2230/604* (2013.01); *F04C 2240/80* (2013.01); *F04C 2270/12* (2013.01)

(58) Field of Classification Search
CPC ..... F04C 15/008; F04C 15/0096; F04C 2/00; F04C 2240/80; F04C 2270/12; F04C 2230/604
See application file for complete search history.

(56) References Cited

U.S. PATENT DOCUMENTS 2,959,372 A * 11/1960 Sadorf ..... B65H 54/2866 242/447.2
3,821,620 A * 6/1974 Lindberg ..... H02P 25/04 310/112
3,844,137 A * 10/1974 Zugel ..... F16D 1/0864 267/154
3,936,238 A * 2/1976 Wycliffe ..... F01C 21/10 417/312
4,834,032 A * 5/1989 Brennan ..... F01B 7/14 123/51 BA
5,154,586 A * 10/1992 Rudick ..... B67D 1/0036 417/415
5,332,371 A * 7/1994 Dantlgraber ..... F04B 1/2014 417/271
2009/0294202 A1* 12/2009 Choi ..... B62D 5/0409 180/425

FOREIGN PATENT DOCUMENTS

| | | |
|---|---|---|
| JP | 9322478 | 12/1997 |
| JP | 2006002569 | 1/2006 |
| JP | 2013060981 | 4/2013 |

OTHER PUBLICATIONS

Notification of Reasons for Refusal dated Sep. 15, 2016 in Japanese Patent Application No. 2014-137167 together with partial English-language translation.
Notification of Reasons for Refusal dated Jan. 23, 2017, issued in Japanese Patent Application No. 2014-137167 together with English-language translation thereof.

* cited by examiner

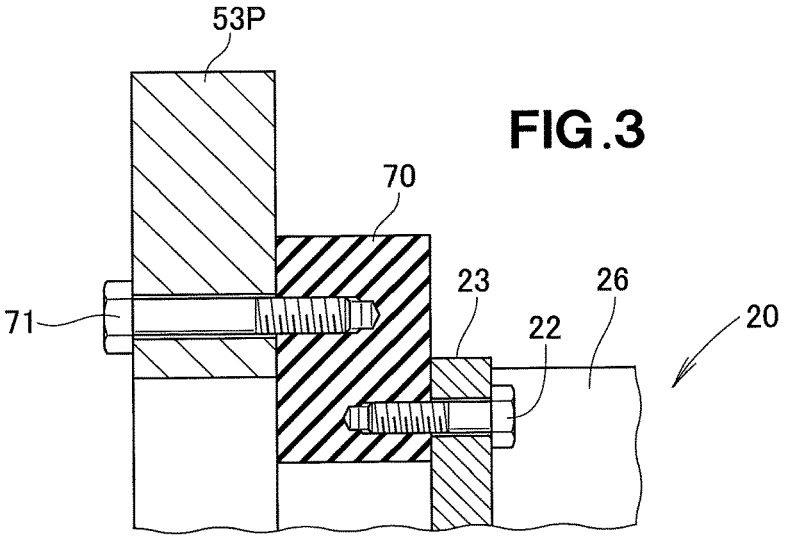
FIG.3
FIG.4
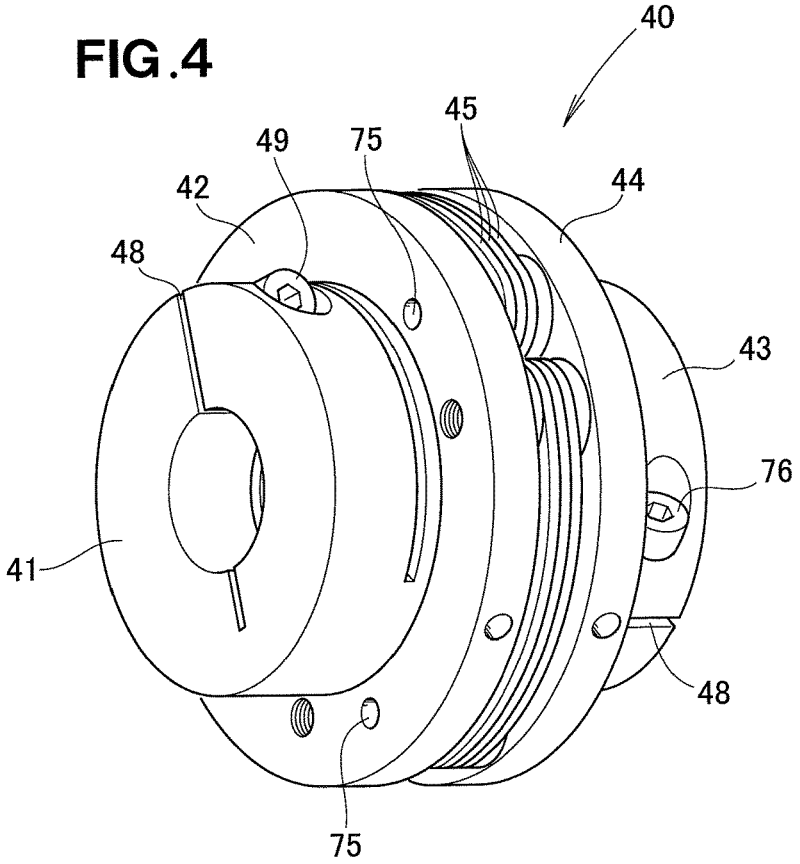

ELECTRIC PUMP APPARATUS

FIELD OF THE INVENTION

The present invention relates to an electric pump apparatus including, primarily, a pump for generating an oil pressure, and a motor for driving the pump.

BACKGROUND OF THE INVENTION

FIG. 7 hereof illustrates a basic structure of a prior art electric pump apparatus 100 disclosed in JP-A-2006-2569. As shown in FIG. 7, the electric pump apparatus 100 includes basic elements, i.e., a vane pump 101 and an electric motor 102 for driving the vane pump 101. More specifically, a mounting bracket 105 is carried on a machine base 103 through an anti-vibration member 104, and an electric motor 102 is secured to the bracket 105. The electric motor 102 has a flange portion 106 mounted to a bell housing 107, and the vane pump 101 is mounted to the bell housing 107 through a damper ring 108.

The vane pump 101 is driven by the electric motor 102 acting as a drive source to pump out liquid. A coupling 112 mechanically interconnecting a motor shaft 109 and the pump shaft 111 is accommodated in the bell housing 107. Although meshing noise is made from the coupling 112 due to rotation of the motor shaft 109, a soundproof effect of the bell housing 107 prevents transmission of the noise to the outside of the apparatus 100, thereby keeping silence of the outside.

The electric pump apparatus 100 shown in FIG. 7 has the following problem. Tubes (oil drawing tubes, oil discharging tubes and electric wirings etc.) are disposed around the electric pump apparatus 100. It is desirable for parts of such tubes to pass under the electric motor 102. However, the electric motor 102 is placed on the installed bracket 105 and hence no tubes can pass under the electric motor 102. As a result, the tubes are disposed in such a manner as to bypass the electric motor 102. This results in an increased floor area occupied by the electric motor and the tubes.

While there is the demand for effective use of the floor area, it is desirable to reduce the floor area occupied by the electric motor and the tubes.

SUMMARY OF THE INVENTION

An object of the present invention is to provide a structure designed such that an electric pump apparatus and tubes occupy a small floor area.

According to an aspect of the present invention, there is provided an electric pump apparatus to be mounted on a machine base having a horizontal mounting surface, the apparatus including a pump for generating an oil pressure, a motor for driving the pump, and a bracket supporting the pump and the motor, wherein the motor is a servo motor with a cooling fan, and the motor comprises: a motor flange connected to the bracket by bolts; a motor shaft disposed horizontally and extending through the motor flange; a rotor mounted on the motor shaft; a stator surrounding the rotor; a motor frame accommodating the rotor and the stator together; a sensor connected to a rear end of the motor shaft; and a fan cover enclosing at least the sensor, the cooling fan being accommodated in the fan cover for air-cooling the motor frame, wherein the bracket comprises: a base portion to be secured to the machine base; and a support plate extending upwardly from the base portion to ensure a gap of a predetermined size between the pump and the mounting surface and a gap of a predetermined size between the motor and the mounting surface, the support plate comprising a pump-side support plate and a motor-side support plate disposed a predetermined distance away from the pump-side support plate.

The pump and tubes overlap and the motor and tubes overlap, as viewed in plan, and hence the electric pump apparatus and the tubes occupy a small floor area.

Further, the support plate comprises the pump-side support plate and the motor-side support plate disposed the predetermined distance away from the pump-side support plate. The pump-side support plate and the motor-side support plate extend upwardly from the base portion. Vibration on a side of the pump is transmitted through the base portion to the motor-side support plate, but is lessened by the base portion because the base portion is secured to the machine base. As a result, the damped vibration is transmitted to a side of the motor.

Preferably, the pump is a flanged axial piston pump, and the pump comprises: a pump flange connected to the bracket by bolts; a pump shaft disposed horizontally and extending through the pump flange; and axial pistons movable in parallel to the pump shaft. The apparatus further comprises a vibration absorbing ring interposed between the support plate and the pump flange for absorbing vibration.

The pump is the axial piston pump. The axial piston pump unavoidably generates vibration in an axial direction of the pump shaft. To address this, the vibration absorbing ring is interposed between the pump flange and the support plate supporting the pump. The vibration absorbing ring eliminates influence of the vibration of the axial piston pump on the motor.

Preferably, the apparatus further comprises a flexible coupling interconnecting the pump shaft and the motor shaft.

The flexible coupling damps the vibration of the pump shaft, and the damped vibration is transmitted to the side of the motor.

BRIEF DESCRIPTION OF THE DRAWINGS

Preferred embodiments of the present invention will be described in detail below, by way of example only, with reference to the accompanying drawings, in which:

FIG. 3 is an enlarged view of a region 3 of FIG. 2;

FIG. 4 is a perspective view of a flexible coupling;

DETAILED DESCRIPTION OF THE PREFERRED EMBODIMENTS

Figure 1:
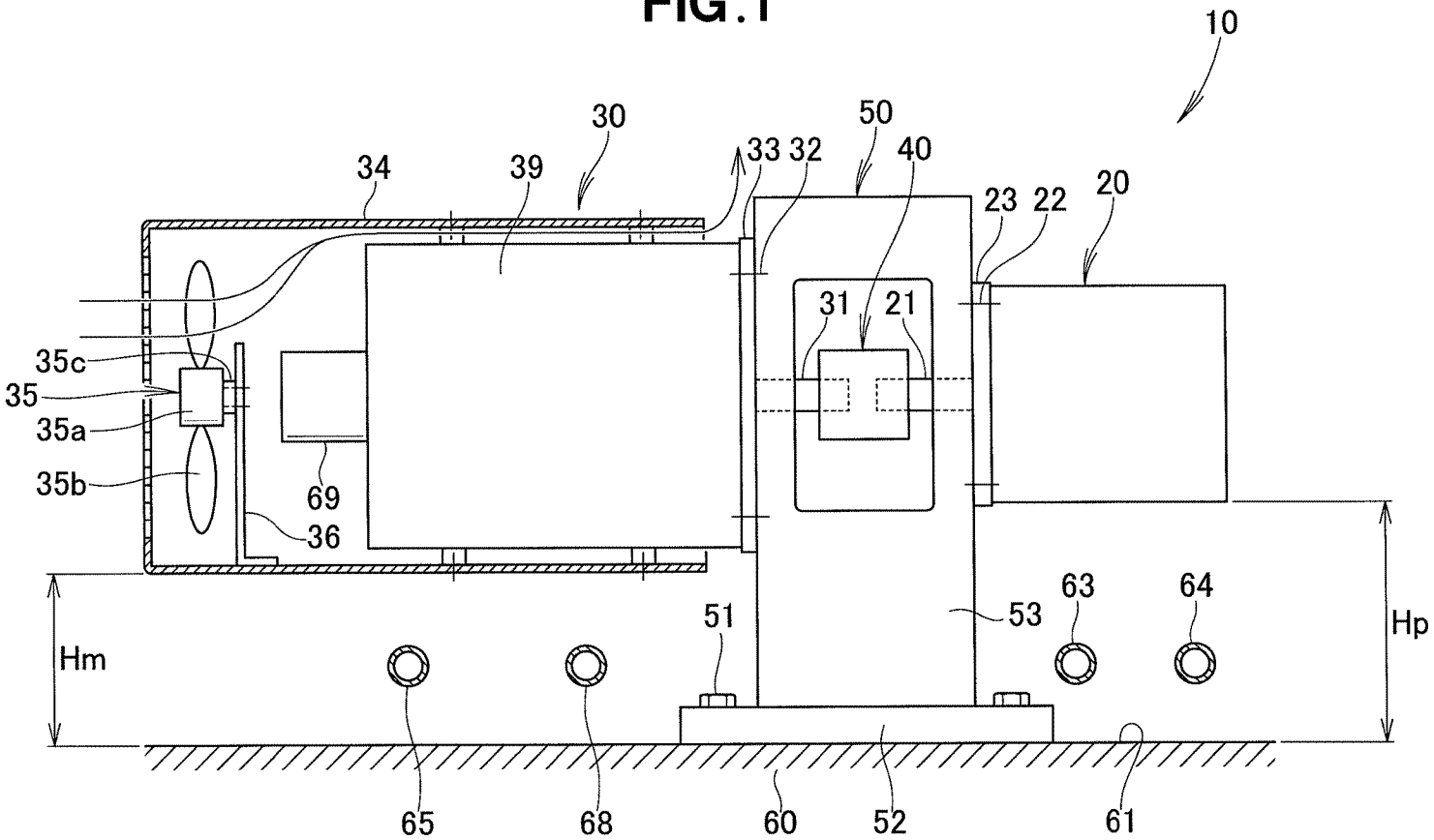
FIG. 1 is a side elevation view of an electric pump apparatus according to the present invention.

As shown in FIG. 1, an electric pump apparatus 10 includes a pump 20 for generating an oil pressure, a motor 30 for driving the pump 20, a coupling 40 mechanically interconnecting a pump shaft 21 and a motor shaft 31, and a bracket 50 supporting the pump 20 and the motor 30. The electric pump apparatus 10 is mounted on a machine base 60 having a horizontal mounting surface 61. The machine base 60 may be any kind of base such as a steel base and a concrete foundation or floor.

The electric pump apparatus 10 is suitable for a hydraulic injection molding machine. That is, the electric pump apparatus 10 supplies oil under high pressure to a clamping cylinder, an injection cylinder and an injector moving cylinder. The single electric pump apparatus supplies oil to the many cylinders. An amount of oil discharged from the pump greatly varies because the many cylinders operate at different timings. The motor 30 is a servo motor to change a speed of the pump to vary the amount of oil discharged from the pump. The servo motor 30 has an inner structure as will be discussed with reference to FIG. 2.

The pump 20 is a hydraulic pump which can be a rotary pump such as a vane pump, a gear pump and a Roots pump. The rotary pump less vibrates in an axial direction of the pump shaft 21.

The motor 30 is the servo motor including a motor flange 33 at a front side thereof, and the motor flange 33 is connected to the bracket 50 by bolts 32. The servo motor also includes the motor shaft 31 disposed horizontally and extending through the motor flange 33.

A general-purpose motor operates continuously at a constant speed during a period of time between activation of the motor and stop of the motor. In contrast, the servo motor 30 is also called a control motor which frequently repeats activation, stop and speed change. An accelerated energy required to accelerate a rotor is mostly consumed by a frictional resistance on a bearing. The same goes for deceleration of the rotor. Thus, the servo motor 30 which is used at a high duty (a high frequency and high load) is desired to have a high cooling performance.

To this end, a fan cover 34 is mounted to the motor with a fan 35 accommodated in the fan cover 34 to perform a forced cooling.

Although various kinds of structures of fans are well-known, the fan 35 preferably employs a fan motor having a structure providing the small overall length of the fan.

That is, the fan motor employed by the fan 35 includes a fan motor frame 35*a* having impellers 35*b* mounted thereon, and a fan motor shaft 35*c* mounted to a stay 36.

More specifically, the stay 36 is disposed in an upright position on the fan cover 34. The fan motor shaft 35*c* is secured to the stay 36. The fan motor frame 35*a* and the impellers 35*b* rotate on the fan motor shaft 35*c*.

A pair of bearings rotatably supporting the fan motor shaft 35*c* is incorporated in the fan motor frame 35*a*.

The bracket 50 is comprised of a base portion 52 secured to the machine base 60 by bolts 51, and a support plate 53 disposed in an upright position on the base portion 52. The support plate 53 has a height dimension set to ensure a gap having a height Hp between the mounting surface 61 and the pump 20 and a gap having a height Hm between the mounting surface 61 and the motor 30.

For example, an oil drawing tube 63 and an oil discharging tube 64 can pass in the gap Hp. A pneumatic pipe 65 and an electric wiring 68 can pass in the gap Hm.

Next, a preferred modification is discussed below with reference to the drawings.

Figure 2:
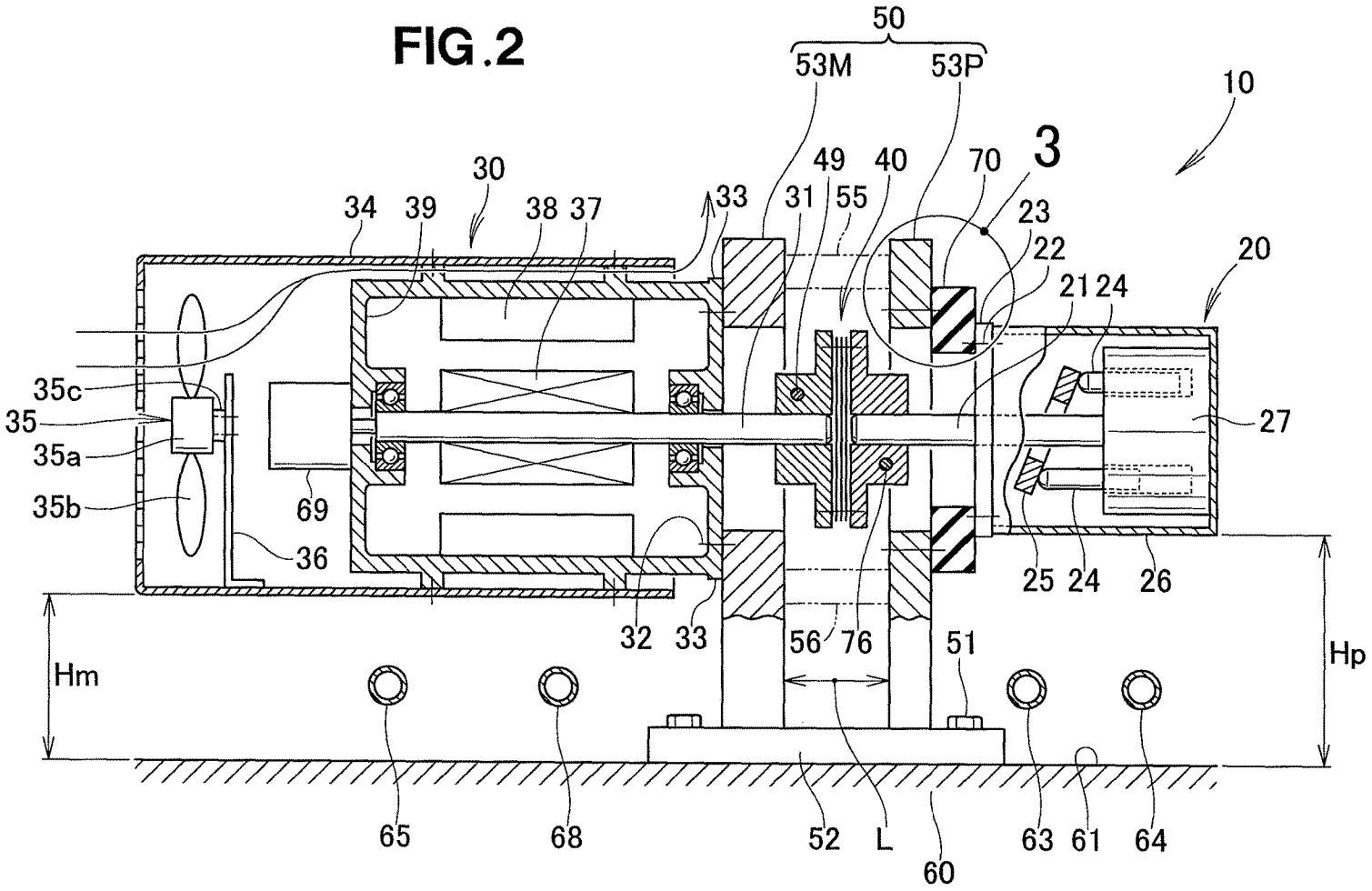
FIG. 2 is a cross-sectional view of another electric pump apparatus.

As shown in FIG. 2, the servo motor 30 with the cooling fan includes a motor frame 39 accommodating a rotor 37 and a stator 38 together. The rotor 37 is mounted on the motor shaft 31 and the stator 38 surrounds the rotor 37. The servo motor 30 also includes a sensor 69 connected to a rear end of the motor shaft 31, and the fan cover 34 encloses the sensor 69 and a major lengthwise portion of the motor frame 39. The servo motor 30 further includes the fan 35 accommodated in the fan cover 34 for air-cooling the motor frame 39.

The pump 20 is a flanged axial piston pump. That is, the pump includes a pump flange 23 at a front side thereof and the pump flange 23 is connected to the bracket 50 by bolts 22. The pump 20 also includes the pump shaft 21 disposed horizontally and extending through the pump flange 23, axial pistons 24, 24 movable in parallel to the pump shaft 21, a swash plate 25 for actuating the axial pistons 24, 24, and a pump case 26 accommodating these elements together.

The axial pistons 24, 24 are provided in a pump rotor 27 and rotated by the pump shaft 21 such that the axial pistons 24, 24 are axially moved by the swash plate 25 to generate an oil pressure. The pump is a reciprocating pump and hence provides a higher oil pressure than that provided by a rotary pump. The axial piston pump is employed depending on an intended purpose.

The reciprocating pump vibrates in the axial direction of the pump shaft 21 much more than the rotary pump does. When this vibration is transmitted to the motor shaft 31, the motor frame 39 vibrates to thereby vibrate the fan cover 34 attached to the motor frame 39, such that the fan motor shaft 35*c* is vibrated through the stay 36.

As is clear from the figure, the servo motor 30 is supported by the bracket 50 in a cantilever fashion and hence even a small amplitude of the motor flange 33 causes a large amplitude of the fan motor shaft 35*c* disposed far from the bracket 50. The two bearings supporting the fan motor shaft 35*c* are small in size and thus inferior in durability, and hence, if the bearings are subjected to the large amplitude, the bearings would reach the end of their useful life in a relatively short period of time.

If large-sized bearings having a prolonged useful life are used, the entire size of the fan 35 would be large, in which case it would be difficult to provide the compact size of the electric pump apparatus 10 and the manufacturing cost of the apparatus would increase.

To meets the need for the compact size of the electric pump apparatus 10 and reduction in the manufacturing cost of the apparatus, the present invention exercises ingenuities discussed below.

First, a structure of the bracket 50 is improved such that vibration on a side of the pump 20 is less likely to be transmitted to a side of the motor 30.

Second, a vibration absorbing ring 70 is interposed between the bracket 50 and the pump 20, such that vibration on the side of the pump 20 is far less likely to be transmitted to the side of the motor 30.

Third, a structure of the coupling 40 is improved.

The three improvements above are discussed in order.

First Improvement: As shown in FIG. 2, the support plate 53 is not a single block, but is formed by a pump-side support plate 53P and a motor-side support plate 53M disposed a predetermined distance L away from the pump-side support plate 53P. Vibration on the side of the pump is transmitted to the pump-side support plate 53P and then to the base portion 52. Since the base portion 52 is secured to the machine base 60, the base portion 52 almost never vibrates. That is, the base portion 52 performs a damping function. The damped vibration is subsequently transmitted to the motor-side support plate 53M. Consequently, the vibration and its amplitude transmitted to the fan 35 are small.

Second Improvement: As shown in FIG. 3, the enlarged view of the region 3 of FIG. 2, the vibration absorbing ring 70 made primarily of rubber which absorbs vibration is interposed between the pump-side support plate 53P and the pump flange 23. The vibration absorbing ring 70 has an inner section (lower section in FIG. 3) overlapping the opening in the pump-side support plate 53P and connected by the bolts 22 to the pump flange 23, and an outer section (upper section in FIG. 3) not overlapping the opening in the pump-side support plate 53P and connected by bolts 71 to the pump-side support plate. The vibration on the side of the pump vibrates the bolt 22, but is absorbed by the vibration absorbing ring 70. Since the vibration is damped by the vibration absorbing ring 70, the bolt 71 slightly vibrates.

The provision of the vibration absorbing ring 70 allows provision of bridges 55, 56 shown by phantom lines. The provision of the bridges 55, 56 increases rigidity of the bracket 50. In FIG. 1, preferably, the vibration absorbing ring 70 is interposed between the bracket 50 and the pump flange 23.

Third Improvement: The coupling 40 is a flexible coupling 40 as shown in FIG. 4.

Figure 5:
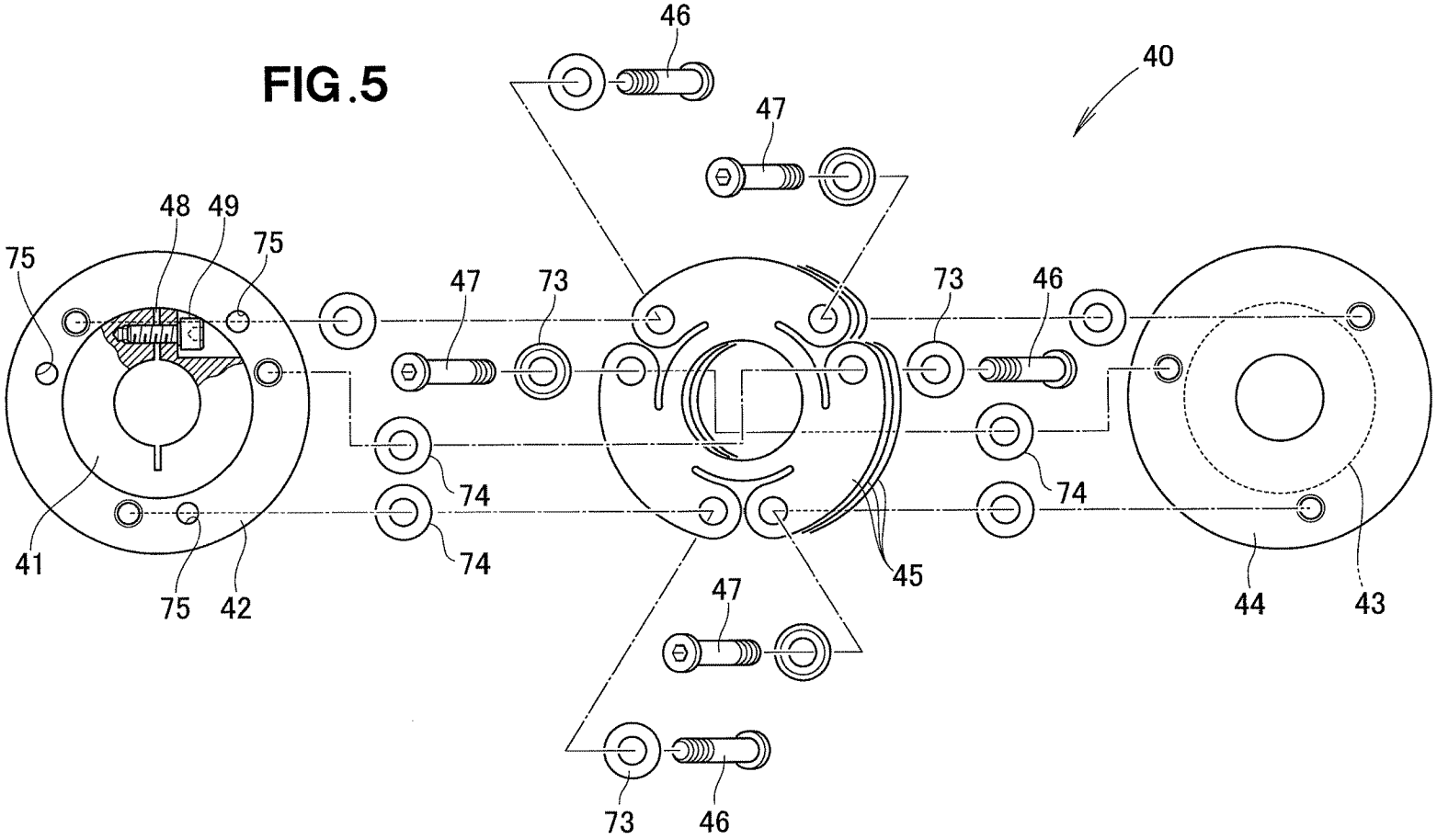
FIG. 5 is an exploded view of the flexible coupling.

As shown in FIG. 5, the flexible coupling 40 is comprised of a first boss 41, a first flange 42 formed integrally with the first boss 41, a second boss 43, a second flange 44 formed integrally with the second boss 43, (three) flexible members in the form of spring leaves 45 sandwiched between the first and second flanges 42, 44, first (three) bolts 46 attaching the spring leaves 45 to the first flange 42, and second (three) bolts 47 attaching the spring leaves 45 to the second flange 44.

The first boss 41 is cut in a direction perpendicular to an axis of the boss to form slits 48, such that a diameter of an axial hole of the first boss 41 is reduced by fastening a first lock bolt 49. The same goes for the second boss 43.

Figure 6:
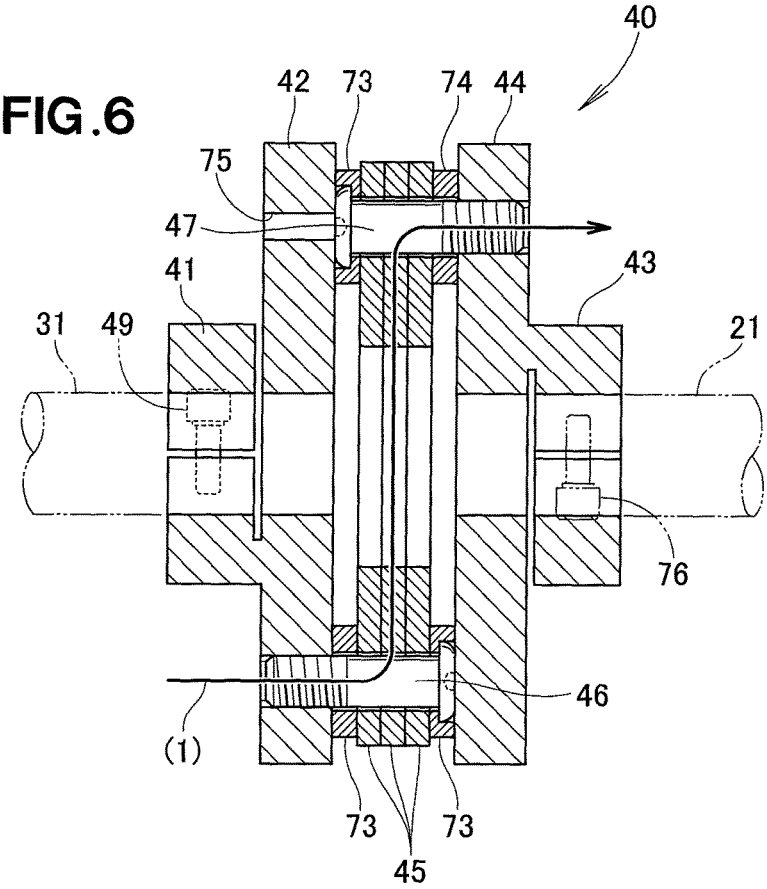
FIG. 6 is a cross-sectional view of the flexible coupling.
Figure 7:
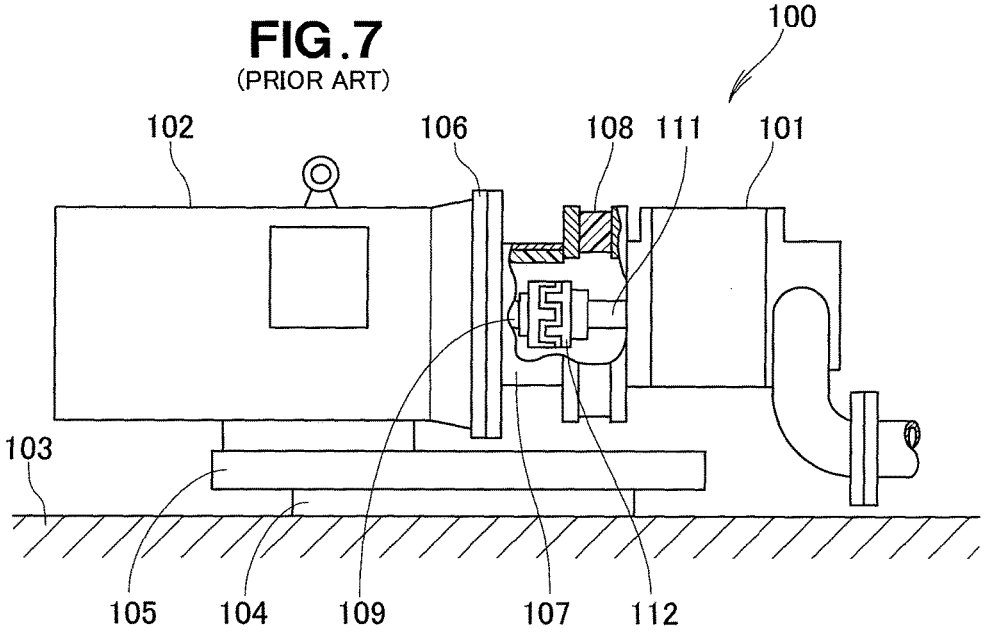
FIG.7 (PRIOR ART)
FIG. 7 is a view illustrating a basic structure of a prior art electric pump apparatus.

The assembled flexible coupling is shown in cross-section in FIG. 6.

As shown in FIG. 6, the leaf spring 45 is attached to the first flange 42 by the first bolts 46 and washers 73, 74. The leaf spring 45 is attached to the second flange 44 by the second bolts 47 and washers 73, 74. The second bolts 47 are finally fastened by a hexagonal wrench inserted into a hole 75 formed through the first flange 42.

A motor torque is transmitted from the motor shaft 31 through the first flange 42, the first bolts 46, the leaf spring 45, the second bolts 47 and the second flange 44 to the pump shaft 21 (as indicated by an arrow (1)). In contrast, vibration of the pump shaft 21 is transmitted toward the motor shaft 31 in a reverse route opposite to the route indicated by the arrow (1). Since the flexible leaf spring 45 has a damping performance, the vibration of the pump shaft 21 is damped and transmitted to the motor shaft 31.

Provision of at least one of the foregoing three improvements can address vibration of the fan 35 shown in FIG. 2, thereby prolonging the life of the fan 35.

Turning to FIG. 2, where one lock bolt 49 of two lock bolts of the flexible coupling 40 is located within a range of the distance L and operable from the outside to rotate, no problems arise even if the other lock bolt 76 is hidden by the pump-side support plate 53P. Thus, the distance L can be freely set.

Although the electric pump apparatus 10 is suitable for the hydraulic injection molding machine, the apparatus 10 can be arranged in other hydraulic circuits.

The flexible coupling 40 may be of any type such as a rubber coupling using a rubber member in place of the leaf spring member.

The electric pump apparatus of the present invention is suitable for the hydraulic injection molding machine.

Obviously, various minor changes and modifications of the present invention are possible in the light of the above teaching. It is therefore to be understood that within the scope of the appended claims the invention may be practiced otherwise than as specifically described.

What is claimed is:

1. A motor-driven pump apparatus mountable on a horizontal mounting surface of a machine base, the motor-driven pump apparatus comprising:

a base portion configured to be mounted on a horizontal mounting surface of a machine base;

a pump-side support plate and a motor-side support plate extending upwardly from the base portion in spaced-apart relationship from each other;

a pump comprising a pump flange connected to an outer side of the pump-side support plate, and a rotary pump shaft extending horizontally through openings in the pump flange and the pump-side support plate and terminating at a front end in the space between the pump-side and the motor-side support plates;

a vibration absorbing ring interposed between the outer side of the pump-side support plate and the pump flange for absorbing vibrations generated by the pump, the vibration absorbing ring having an inner section overlapping the opening in the pump-side support plate and connected to the pump flange, and an outer section not overlapping the opening in the pump-side support plate and connected to the pump-side support plate;

a servo motor comprising a motor flange connected to an outer side of the motor-side support plate, a rotary motor shaft extending horizontally through openings in the motor flange and the pump-side support plate and terminating at a front end in the space between the pump-side and the motor-side support plates, a rotor mounted on the motor shaft, a stator surrounding the rotor, a motor frame connected to the motor flange and enclosing the rotor and the stator, a sensor connected to a rear end of the motor shaft, a fan cover enclosing both the sensor and a major lengthwise portion of the motor frame, and a cooling fan disposed inside the fan cover to circulate air in a space between the fan cover and the motor frame to air-cool the motor frame; and a coupling disposed in the space between the pump-side and the motor-side support plates and interconnecting the pump shaft and the motor shaft.

2. A motor-driven pump apparatus according to claim 1; wherein the pump comprises a variable displacement pump.

3. A motor-driven pump apparatus according to claim 2; wherein the variable displacement pump is an axial piston pump.

4. A motor-driven pump apparatus according to claim 3; wherein the coupling comprises a flexible coupling.

5. A motor-driven pump apparatus according to claim 4; wherein the flexible coupling comprises a first flange fastened to the front end portion of the motor shaft, a second flange fastened to the front end portion of the pump shaft, and flexible members interposed between and connected to the first and the second flanges.

6. A motor-driven pump apparatus according to claim 5; wherein the flexible members comprise spring leaves.

7. A motor-driven pump apparatus according to claim 6; wherein the first flange is fastened to the motor shaft by a first lock bolt and the second flange is fastened to the pump shaft by a second lock bolt, at least one of the lock bolts being situated in the space between the pump-side and the motor-side support plates and being accessible from outside the apparatus.

8. A motor-driven pump apparatus according to claim 1; wherein the coupling comprises a flexible coupling.

9. A motor-driven pump apparatus according to claim 8; wherein the flexible coupling comprises a first flange fastened to the front end portion of the motor shaft, a second flange fastened to the front end portion of the pump shaft, and flexible members interposed between and connected to the first and the second flanges.

10. A motor-driven pump apparatus according to claim 9; wherein the flexible members comprise spring leaves.

11. A motor-driven pump apparatus according to claim 10; wherein the first flange is fastened to the motor shaft by a first lock bolt and the second flange is fastened to the pump shaft by a second lock bolt, at least one of the lock bolts being situated in the space between the pump-side and the motor-side support plates and being accessible from outside the apparatus.

12. A motor-driven pump apparatus according to claim 1; wherein the inner section of the vibration absorbing ring is bolted to the pump flange, and the outer section of the vibration absorbing ring is bolted to the pump-side support plate.

13. A motor-driven pump apparatus according to claim 1; wherein the pump-side support plate and the motor-side support plate extend upwardly to the same level and constitute respectively the sole support for the pump and the motor.

* * * * *